US008771814B2

(12) United States Patent
Ciaffara et al.

(10) Patent No.: US 8,771,814 B2
(45) Date of Patent: Jul. 8, 2014

(54) REUSABLE PLACEMAT WITH STRAP

(75) Inventors: Laura Ciaffara, Saint Charles, IL (US); Amy Seitz, Saint Charles, IL (US)

(73) Assignee: My Own Mat, Inc.

( * ) Notice: Subject to any disclaimer, the term of this patent is extended or adjusted under 35 U.S.C. 154(b) by 649 days.

(21) Appl. No.: 12/474,985

(22) Filed: May 29, 2009

(65) Prior Publication Data

US 2009/0297743 A1 Dec. 3, 2009

Related U.S. Application Data

(60) Provisional application No. 61/057,193, filed on May 29, 2008.

(51) Int. Cl.

| | |
|---|---|
| ***B32B 1/02*** | (2006.01) |
| ***B32B 27/06*** | (2006.01) |
| ***A47D 15/00*** | (2006.01) |
| ***A47G 23/03*** | (2006.01) |

(52) U.S. Cl.
USPC ..... 428/35.2; 428/99

(58) Field of Classification Search
CPC ..... B32B 1/02; B32B 27/06; A47D 15/00–15/003; A47D 5/00–5/006; A47G 23/00–23/0303
USPC ..... 428/35.2, 99
See application file for complete search history.

(56) References Cited

U.S. PATENT DOCUMENTS

| | | | | |
|---|---|---|---|---|
| 4,793,004 | A * | 12/1988 | Long et al. | 2/49.3 |
| 2001/0044249 | A1* | 11/2001 | Demott et al. | 442/304 |
| 2003/0226205 | A1* | 12/2003 | Fishman | 5/413 R |
| 2005/0120457 | A1* | 6/2005 | Mesalic | 2/49.1 |
| 2008/0187709 | A1* | 8/2008 | Hester et al. | 428/99 |

* cited by examiner

*Primary Examiner* — Erik Kashnikow
(74) *Attorney, Agent, or Firm* — McAndrews, Held & Malloy, Ltd.

(57) ABSTRACT

A placemat that is reusable and easily transported even when dirty or wet. The placemat consists of a six-sided surface of waterproof flexible material forming the bottom, a same-shaped water resistant material forming a central layer, and a same-shaped absorbent material forming the top layer. Two straps are attached to the placemat; at the point of attachment the strap forms a loop, allowing the use of a pin or other implement to attach the mat to a soft surface. At the loose end of each strap is a pair of snaps, allowing the user to fasten the strap around an object in use by the child or baby to prevent the object from falling to the floor or ground. On the bottom of the mat is a pair of suction cups that allow the placemat to be attached to a hard surface where a pin would not be of use. The mat has two pairs of snaps located along the side edges at the proximal edge so a crumb catcher can be formed when the snaps are snapped together. When folded in the proper fashion, the placemat may be turned inside-out into a pocket located on the back of the mat, allowing for clean transportation without the need to clean the placemat beforehand.

13 Claims, 2 Drawing Sheets

REUSABLE PLACEMAT WITH STRAP

RELATED APPLICATIONS

This application claims propriety to U.S. Provisional Patent Application Ser. No. 61/057,193, having a filing date of May 29, 2008, which is incorporated herein by reference.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

When taking small children out to eat, providing a sanitary surface to eat from and keeping toys, pacifiers, etc off the dirty floor are just two issues that concern parents today. Even in a home, keeping an area where a child eats clean and their toys off the floor is difficult. With these concerns, a portable placemat with straps is useful to allow the child to eat off a clean, sanitary surface and keep items contained by the strap from falling onto a floor. Also, by having a placemat that is reusable, keeps unneeded waste from the landfills. Many placemats offer the ability to be placed in a bag to be transported, but few are reusable. Popular sanitary placemats are for one time use and must be disposed of. Those types are not cost effective. Nor are they environmentally friendly. There are also other types of placemats that can be reused. However, they may not have a cleaner surface than the table that they are covering and they do not have the ability to constrain toys, pacifiers, etc. The reason is the plastic or rubber material that they are made of. If the purchaser does not clean the surface in a proper and timely manner, bacteria can begin to grow in the porous material that can only be killed with harsh chemicals. Traditional placemats cannot be adhered to a surface and can easily be moved by a child defeating the purpose of the mat.

Placemats that are made of cellulosic material with adhesive backings (Patent US 2002/0160184 Cho) work well in keeping a surface sanitary but do not allow the purchaser to reuse the placemat. If a liquid was to spill on the surface of the mat, the liquid would spread over the surface and onto the child.

Placemats made up of rubber like material (U.S. Pat. No. 6,746,745) are reusable but do not absorb spilled liquids. This causes concern when it is time to transport the placemat. The placemat must be cleaned before placed in a diaper bag, purse, or any other bag. This does not offer the convenience of being able to be folded quickly and place in said bag. This placemat also does not have straps to constrain a child's toy, pacifier, etc.

BRIEF SUMMARY OF THE INVENTION

A placemat (or changing mat) which allows for a clean eating (or changing) surface by creating a waterproof barrier against an external surface (e.g., public restaurant table, public restroom changing table, etc.), while at the same time providing an absorbent surface to prevent the spreading of various fluids inherent in eating or changing diapers. In addition, the mat has one or more straps to which can be attached toys, pacifiers, eating utensils, etc., preventing the child from dropping or throwing said items onto the floor or ground. In the preferred embodiment, the ends of the straps may be fastened into loops by means of metal snaps for the purpose of attaching objects to the mat. At the top of the strap is a pin loop so that the mat can be adhered to a cloth surface by means of a straight pin, safety pin or other implement. There is a suction cup connected to the back surface so that the mat may be adhered to a hard surface where a pin would not readily work. In the preferred embodiment there are two pairs of snaps on opposite sides and near the lower edge of the top of the mat, that when snapped together create a pocket which will catch crumbs or other material that would normally fall off of the table. On the back surface of the preferred embodiment, a pocket is stitched allowing the mat to be folded into it, containing any fluids the absorbent material has absorbed and allowing for clean transportation without the need to clean the mat.

DETAILED DESCRIPTION OF THE PREFERRED EMBODIMENT

Figure 1:
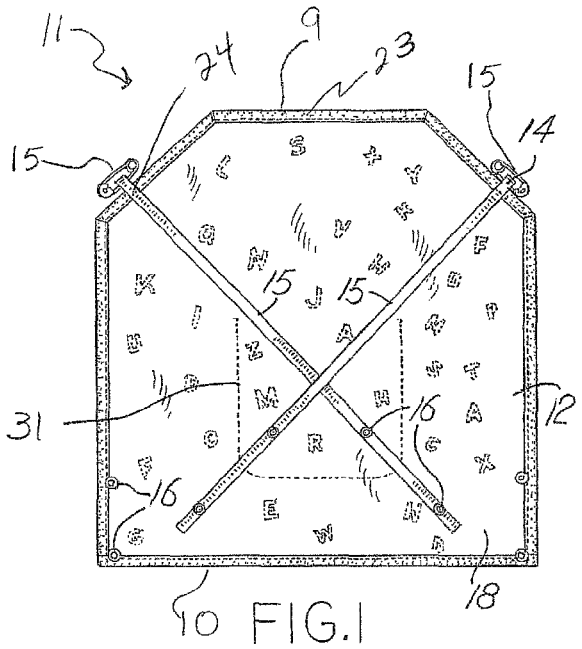
FIG. 1 is a top view of a placemat embodiment of the present invention.
Figure 2:
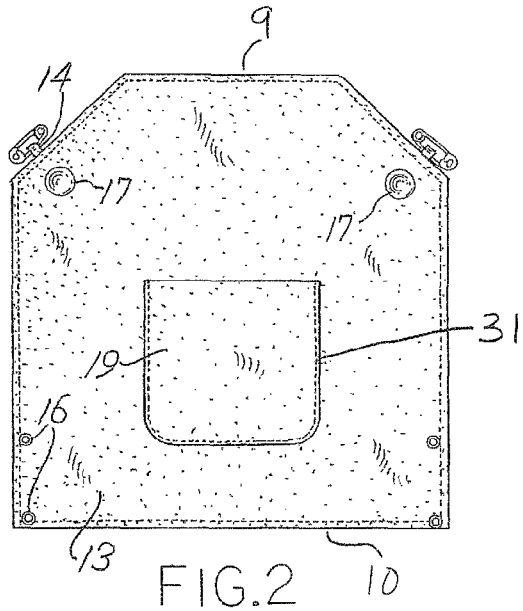
FIG. 2 is a bottom view of the placemat of FIG. 1.

Referring to FIGS. 1 and 2, a planar mat 11 includes six edges, two of which being a distal edge 9 and a proximal edge 10. Mat 11 has a top surface 12 (FIG. 1) and a bottom surface 13 (FIG. 2). Surface 12 is formed of an absorbent material such as, but not limited to, cotton. Bottom surface 13 may be formed of a waterproof material. As shown, the material forming bottom surface 13 may be folded over and stitched onto the front surface 12 to provide a border 23 circumscribing the outer boundary of the mat.

The materials forming the top surface 12 and bottom surface 13 are flexible, allowing mat 11 to be folded, as described below. Top surface 12 is of a size for covering an area in front of a seated child, to provide a clean area from which the child can eat. For example, a size of eighteen inches by eighteen and a half inches provides a suitable area.

A pair of straps 15 are attached respectively to mat 11 by stitching 24. Straps 15 are made of, but not limited to, a poly blend, flexible material. Each strap 15 extends beyond surface 12 and is folded back to receive stitching 24, so as to form a loop 14. Each loop 14 receives a safety pin 15 for use to secure the mat to a cloth surface, for example a tablecloth. Other securing devices may be used. At the other end of each strap are a pair of spaced-apart snaps 16 which may be snapped together to form a loop 17 (FIG. 3) that is able to secure a child's toy, pacifier, eating implement, or such, to the strap. As will suggest itself, buckles, ties, Velcro®, closers, buttons, etc., may be used in place of snaps 16.

Figure 3:
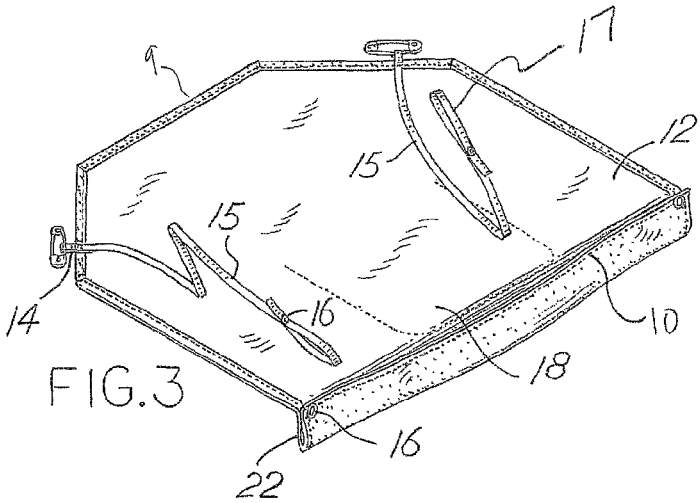
FIG. 3 is a perspective view of the placemat of FIG. 1.

Two further spaced-apart pairs of snaps 16 are located along the two sides of mat 11, in the area of the proximal edge of mat 11, as shown. When these further pairs of snaps are snapped together, as shown in FIG. 3, a crumb catcher 22 is formed from the mat and that will hang over the edge of a table (not shown).

As shown in FIG. 2, a pocket 19 is centrally located on bottom surface 13 of mat 11. Pocket 19 is formed from a four-sided piece of material which is attached by stitching 31 formed on three sides of the pocket. Stitching 31 is visible on front surface 12, as shown in FIG. 1. As will suggest itself, pocket 19 may be attached by stitching, glue or the like. Pocket 19 may be formed of, but is not limited to, the same absorbent material as that of front surface 12.

Referring to FIG. 2, a pair of suction cups 17 are secured to the bottom surface of the mat in the area of its distal edge, as shown. Suction cups 17 allow mat 11 to be connected to a hard surface, for example, a table top not having a table cloth. In such a case, safety pins 15 would not be used to secure mat 11 in place.

Figure 4:
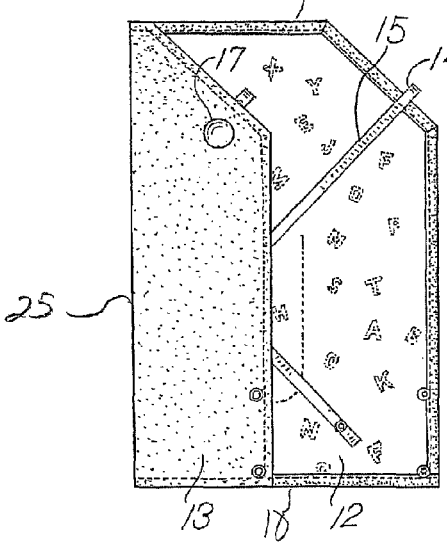
FIGS. 4, 5, 6, 7, 8A, 8B and 8C illustrate the consecutive steps in which the placemat of FIG. 1 is folded up and tucked into itself for transportation.
Figure 5:
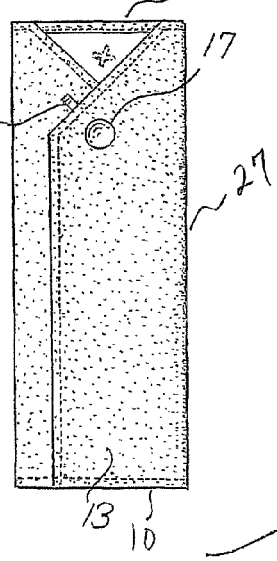
Figure 8A:
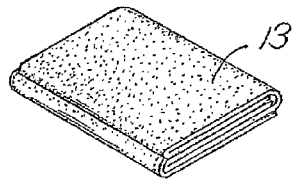
Figure 8B:
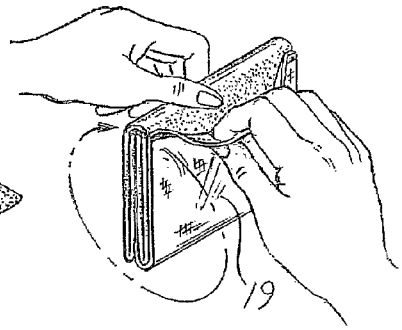
Figure 6:
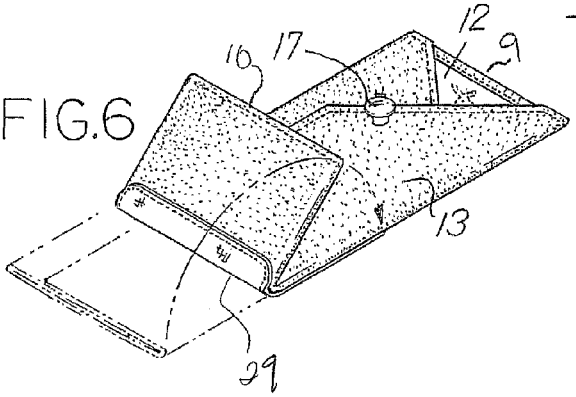
Figure 8C:
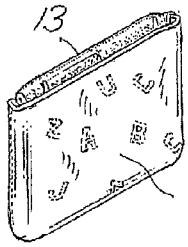
Figure 7:
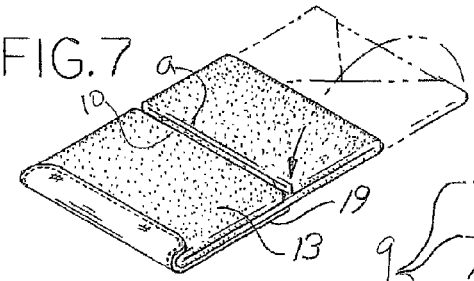

As illustrated in FIGS. 4-8, mat 11 may be folded and turned into pocket 19 as a means of clean storage. First, the left edge of mat 11 is folded over front surface 12, so that the fold line 25 is flush with the right side of pocket 19, as shown in FIG. 4. Next, as shown in FIG. 5, the right edge of mat 11 is folded over front surface 12, so that the fold line 27 is flush with the right side of pocket 19. Next, as shown in FIG. 6, the proximal edge of mat 11 is folded toward its distal edge so that the fold line 29 passes through the bottom area of pocket 19. Next, the distal edge of mat 11 is folded toward its proximal edge so that the distal edge is flush with the proximal edge, as seen in FIG. 7. Next, mat 11 is folded where the distal and proximal edge meet in FIG. 7, as shown in FIG. 8A. Next, as shown in FIG. 8B, the pocket 19 is opened and turned inside out, stuffing the mat inside of itself. As shown in FIG. 8C, the mat is fully folded and turned inside out, stuffed into its own pocket. The outside of folded mat 11 is now the water proof material of bottom surface 13, preventing any fluids that have been absorbed in top surface 12 from leaking out during transportation.

Pocket 19 provides a means by which to turn the folded mat 11 inside out for storage. As such, it may be desirable to use a material having patterns on only one side of pocket 19, and to attach pocket 19 onto the bottom surface 13. Thus, when the mat is viewed open, as in FIG. 2, the pattern on the pocket is against surface 13 and not visible; when the mat is turned inside-out, as in FIG. 8C, the pattern of the pocket will be visible.

Figure 9:
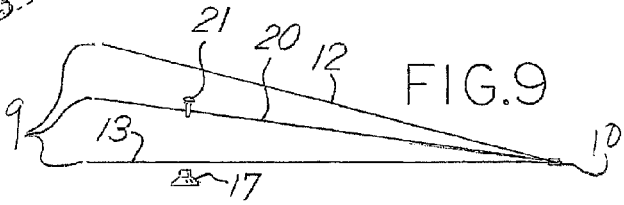
FIG. 9 is an exploded side view of the mat of FIG. 1.

Referring to FIG. 9, mat 11 may consist of three separate layers: an absorbent front surface 12, a waterproof back surface 13, and an additional middle surface 20. The middle surface 20 may consist of, but not be limited to, a waterproof or water-repellant and flexible material, such as vinyl, allowing for mat 11 to be folded up. Middle surface 20 is the same size and shape as top surface 12 and bottom surface 13.

A tack 21 may be used to bind together middle surface 20 and bottom surface 13 by inserting tack 21 through both surfaces and then into suction cup 17. Tack 21 also serves to hold suction cup 17 in position on the mat.

While particular steps, elements, embodiments and applications of the present invention have been shown and described, it will be understood, of course, that the invention is not limited thereto since modifications can be made by persons skilled in the art, particularly in light of the foregoing teachings. It is therefore contemplated by the appended claims to cover such modifications as incorporate those steps or elements that come within the scope of the present invention.

We claim:

1. A placemat for use by a child comprising:

a bottom surface layer formed of a flexible waterproof material, said bottom surface layer having a size defining an area from which a child can eat;

a top surface layer formed of a flexible absorbent material, said flexible absorbent material being washable allowing for re-use of the placemat, said top surface layer being generally coextensive with said bottom surface layer, both surface layers being joined at corresponding edges to form an open mat structure;

a pocket secured to said bottom surface layer at a central location thereof, wherein the pocket is defined by opposed side edges and a bottom edge secured to said bottom surface, wherein the pocket further includes an open edge defining an opening of said pocket; and wherein said open mat structure folds about fold lines that are flush with said opposed side edges, said open edge, and said bottom edge to an intermediate folded mat structure, and wherein said intermediate folded mat structure is dimensioned to be turned inside out into said open edge to form a final folded mat structure having dimensions directly corresponding to dimensions of the pocket.

2. The placemat of claim 1, and further including a middle surface layer, of the same shape and size as said bottom surface layer and said top surface layer, said middle surface layer formed of a flexible water resistant material, and affixed at corresponding edges between said bottom and top surface layers.

3. The placemat of claim 1, and further including a strap.

4. The placemat of claim 3, wherein a set of snaps is attached at an end of said strap, which allows the strap to be fastened around an item to prevent said item from falling away from the placemat.

5. The placemat of claim 1, and further including apparatus attached at or on the bottom surface layer of the mat, allowing the mat to be affixed to a hard surface.

6. The placemat of claim 1, and further including two pairs of snaps that when snapped together form a crumb catcher that will hang over the edge of a table, and prevent food from falling from the table.

7. A mat comprising:

a planar sheet having a top surface and a bottom surface forming an open mat structure;

a pocket centrally located on said bottom surface; and wherein said open mat structure is foldable about fold lines that are flush with edges of said pocket to an intermediate folded mat structure, and wherein said intermediate folded mat structure is dimensioned to be turned inside out into said pocket to form a final folded mat structure having dimensions directly corresponding to dimensions of the pocket.

8. The mat of claim 7, further comprising a securement strap connected to said mat, said securement strap being securable to a pacifier.

9. The mat of claim 7, further comprising a loop secured thereto.

10. The mat of claim 7, further having a securement apparatus positioned on the bottom surface of said mat.

11. The mat of claim 7, further having a securement apparatus located relative to a proximal edge of said mat to provide a fold in the mat to catch crumbs when the mat is in the open mat structure.

12. The mat of claim 7 wherein:

said bottom surface is formed of a layer of flexible waterproof material; and said top surface is formed of a layer of flexible absorbent material.

13. The mat of claim 12, further comprising an intermediate layer disposed between said top surface layer and said bottom surface layer, said intermediate layer formed of a flexible waterproof material.

* * * * *